US009155343B1

(12) United States Patent
Robbins

(10) Patent No.: US 9,155,343 B1
(45) Date of Patent: Oct. 13, 2015

(54) PATIENT LIFT ASSIST HARNESS

(71) Applicant: Holly L Robbins, Lakeville, MA (US)

(72) Inventor: Holly L Robbins, Lakeville, MA (US)

( * ) Notice: Subject to any disclaimer, the term of this patent is extended or adjusted under 35 U.S.C. 154(b) by 0 days.

(21) Appl. No.: 14/506,723

(22) Filed: Oct. 6, 2014

(51) Int. Cl.
*A41F 9/00* (2006.01)

(52) U.S. Cl.
CPC ..... *A41F 9/005* (2013.01); *A41F 9/002* (2013.01)

(58) Field of Classification Search
CPC ..... A41F 3/00; A41F 11/16; A41F 9/002; A41D 13/0015; A41D 13/02; A41D 1/04; A61F 5/028; A62B 35/04; A47D 13/086; B64D 17/30
USPC ..... 2/310, 311, 312, 69, 79, 102, 44–45; 182/3, 4, 6; 119/769, 770; 244/151 R
See application file for complete search history.

(56) References Cited

U.S. PATENT DOCUMENTS

| | | | | |
|---|---|---|---|---|
| 2,431,358 | A * | 11/1947 | Wilson | 244/151 A |
| 4,553,633 | A * | 11/1985 | Armstrong et al. | 182/3 |
| 4,905,678 | A | 3/1990 | Cumins et al. | |
| 4,932,079 | A * | 6/1990 | Bridgewater | 2/313 |
| 4,973,044 | A | 11/1990 | Jones | |
| 5,177,813 | A * | 1/1993 | Bosack et al. | 2/323 |
| 5,289,590 | A * | 3/1994 | Larson | 2/227 |
| 5,388,551 | A * | 2/1995 | Martusciello | 119/770 |
| 5,397,171 | A | 3/1995 | Leach | |
| 5,435,272 | A * | 7/1995 | Epstein | 119/770 |
| 5,526,893 | A | 6/1996 | Higer | |
| 5,893,367 | A | 4/1999 | Dubats et al. | |
| 5,896,859 | A | 4/1999 | Carroll | |
| 6,076,527 | A | 6/2000 | Rottinghaus et al. | |
| 6,438,756 | B1 * | 8/2002 | Colorado | 2/81 |
| 6,968,809 | B2 * | 11/2005 | Reardon | 119/770 |
| 7,066,181 | B2 | 6/2006 | West | |
| 7,490,610 | B2 | 2/2009 | Franklin | |
| 2003/0140414 | A1 | 7/2003 | Wake | |
| 2013/0205466 | A1 | 8/2013 | Arnold | |

OTHER PUBLICATIONS

Mobility Transfer Systems, SafetySure Mary's Aide Transfer Sling, Mar. 2011.
Mobility Transfer Systems, SafetySure Universal Thigh Straps, Mar. 2011.
Ergotrans Patient Transfer Harness, Transfer On3, Inc., 2011.

* cited by examiner

*Primary Examiner* — Tejash Patel
(74) *Attorney, Agent, or Firm* — Altman & Martin; Steven K Martin

(57) ABSTRACT

A patient lift assist harness composed of a single or multiple layer sheet of flexible fabric material in a generally elongated X shape with a central crotch portion, two first arms, and two second arms. The first arms are at an angle of approximately 45° to each other, and the second arms are at an angle of approximately 45° to each other. Belt loops at the ends of the arms are adapted to receive a gait belt. The gap between the first arms, the gap between the second arms, and the space between first and second arms at the sides expose the gait belt around the patient, thereby providing hand holds for the therapist.

13 Claims, 6 Drawing Sheets

PATIENT LIFT ASSIST HARNESS

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to physical therapy, more particularly, to devices that aid in helping therapists to lift and transfer patients and to aid in walking, as well as reduce the physical strain on the therapist.

2. Description of the Related Art

Gait belts are traditionally used for safety and to provide a secure hold for therapists when assisting a patient with transfers or gait training. There is a "text book" way to use a gait belt, but unfortunately unique and difficult situations present themselves regularly during the process of physical rehabilitation. Gait belts are mostly applied while the patient is sitting and they often loosen as the patient is lifted, especially with patients who are larger or lack good pelvic and trunk control, causing the belt to ride up to their chest and change the center of gravity. This makes it difficult for the therapist to give manual facilitation where needed and offers the patient little support. Often this causes caregivers to grab patients by their arms or their pants to gain control, which can be harmful and uncomfortable for the patient.

There are harnesses on the market that are used for transfers and gait training. None of them attach to gait belts. They appear difficult to don with many straps and fasteners, and are expensive.

Thigh straps wrap around the patient's thigh, through the crotch, and around the gait belt. They are uncomfortable because they are narrow and dig into the patient's crotch area during use.

BRIEF SUMMARY OF THE INVENTION

The patient lift assist harness of the present invention attaches easily to any gait belt and provides support for a patient by a person aiding the patient.

The harness is single piece of flexible material in a generally elongated X shape with a central crotch portion, two first arms extending from the crotch portion, and two second arms extending from the crotch portion. The first arms are at an angle of approximately 30° to approximately 65° to each other, as are the second arms.

Each arm end has a belt loop through which a gait belt extends. The present invention contemplates a number of different methods for forming the belt loops. In the first, the ends of the arms are folded over and sewn. In the second, separate portions of material are sewn over the ends of the arms.

In the third method, two mirror image harness shape sections are formed from a single sheet, folded to overlap, and the edges sewn. One pair of loops is between the two sections at the fold. The other pair of loops is formed by folding the arm ends over and sewing.

In the fourth method, two mirror image harness shape sections are formed from a single sheet, folded to overlap, and the edges sewn. One pair of loops is between the two sections at the fold. The other pair of loops is formed by sewing the ends of the arms.

The size of the harness will depend on the size of the patient with which it will be used. Typically, the harness is made in standard sizes that fit a range of patients.

After the harness is put in a patient, the gap between the first arms, the gap between the second arms, and the space between first and second arms at the sides expose the gait belt around the patient. These exposed sections of the gait belt provide hand holds for the therapist.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

The patient lift assist harness of the present invention provides support for a patient by a physical therapist or other person aiding the patient. It attaches easily to any gait belt through robust loops and can be put on and removed while the patient is sitting, laying down, or standing. It offers support through the pelvis, a secure lifting point, and keeps the gait belt at the patient's waist to ensure good body mechanics for both the patient and therapist.

Figure 1:
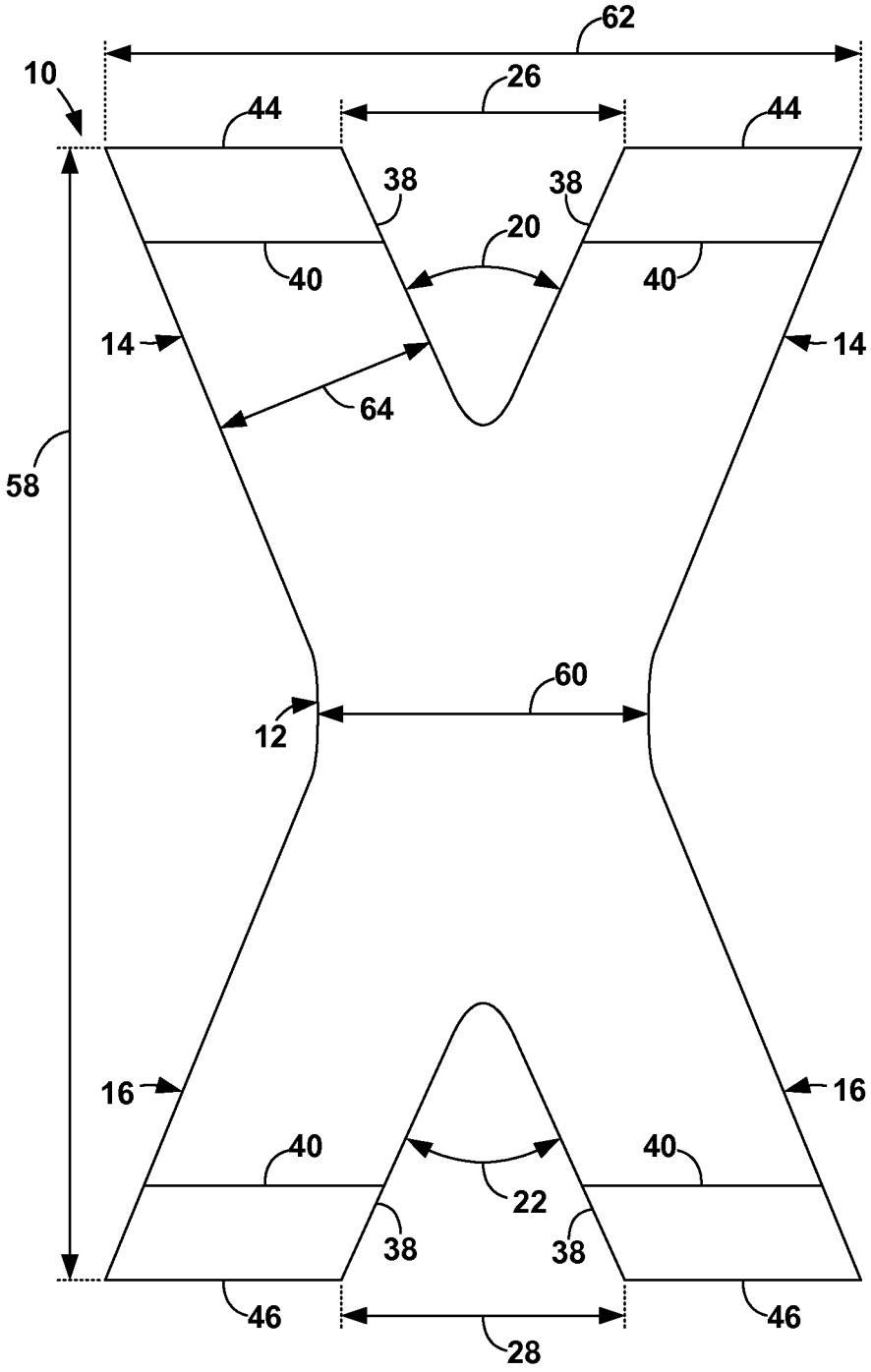
FIG. 1 is a front view of the patient lift assist harness of the present invention laid out.

The patient lift assist harness 10 of the present invention is shown in the figures. As seen in FIG. 1, the harness is single piece of flexible fabric material in a generally elongated X shape. The preferred material is a water resistant, washable polyester, but any fabric with the desired durability can be used.

The harness 10 has a central crotch portion 12 with two first arms 14 extending from the crotch portion 12 to free ends 44 and two second arms 16 extending from the crotch portion 12 to free ends 46. The two first arms 14 are at a first angle 20 from each other in the range of from approximately 30° to approximately 65° angle. The two second arms 16 are at a second angle 22 from each other in the range of from approximately 30° to approximately 65°. The preferred angle is in the range of from approximately 40° to approximately 50°. The first arm free ends 44 are generally collinear and the second arm free ends 46 are generally collinear. There is a gap 26 between the first arm free ends 44 and a gap 28 between the second arm free ends 46. The widths of the gaps 26, 28 depend on the size of the harness 10, as described below.

Figure 2:
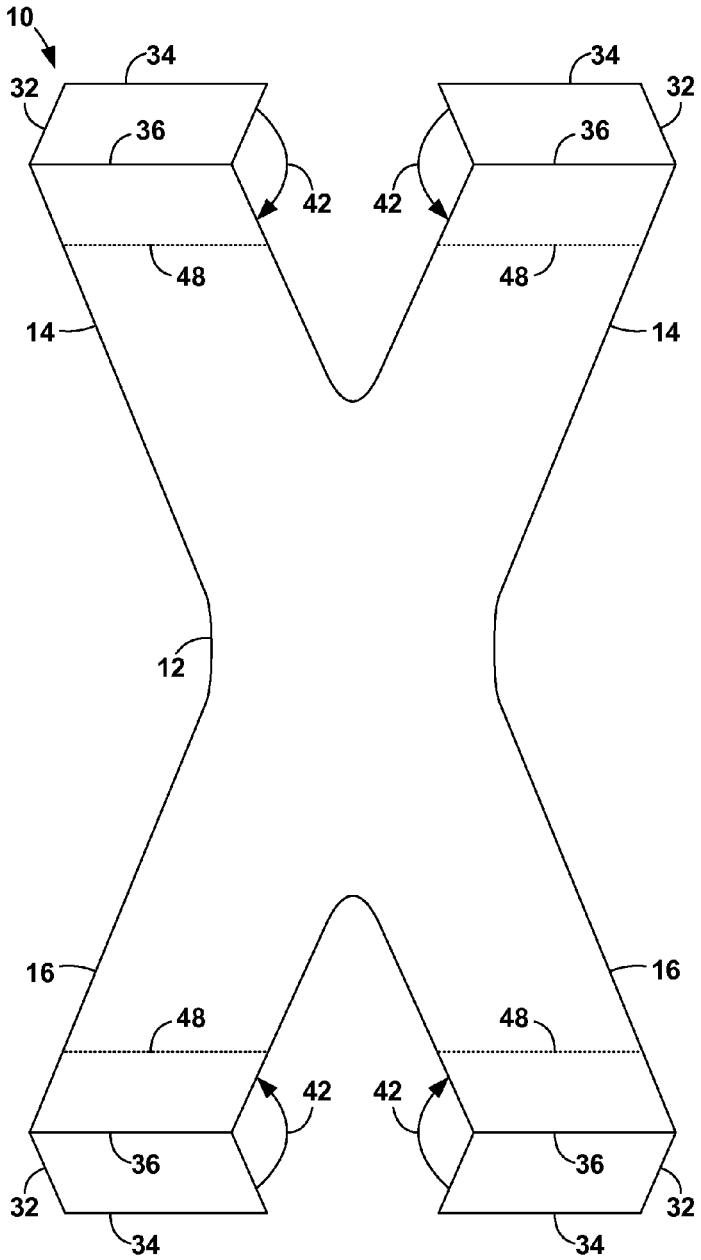
FIG. 2 is a front view of the harness of FIG. 1 before the belt loops are formed in the first method.

Each arm 14, 16 has a belt loop 38 adjacent to and parallel to the arm free end 44, 46. The present invention contemplates a number of different methods for forming the belt loops 38. In the first, shown in FIG. 2, the harness 10 is composed of a single layer of material. Each arm 14, 16 includes a loop extension 32 that extends to an extension end 34. The loop extension 32 is at an angle to the rest of the arm 14, 16 so that when the loop extension 32 is folded over at an extension fold line 36, as at 42, the loop extension 32 lays over the arm 14, 16, as in FIG. 1. The extension end 34 is stitched to the arm, as at 48, to form the loop 38. The extension fold line 36 becomes the free end 44, 46.

Alternatively, the harness 10 is composed of two or more layers that are sewn together at the edges. Preferably, the layers are sewn together inside out, and then inverted so that the outside is out. This has the advantage of hiding the sewn seams around the edges.

Figure 3:
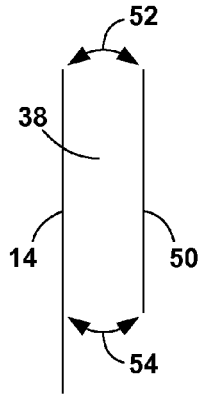
FIG. 3 is a side view of one arm end of the harness of FIG. 1 before the belt loop is formed in the second method.

In the second method, shown in FIG. 3, the harness 10 is composed of a single or multiple layers of material. The loop 38 is formed by placing a separate strip of material 50 on the arm 14, 16 and stitching the two transverse edges, as at 52, 54. The major shortcoming of this structure is that, when lifting the patient, the gait belt is putting pressure directly on the outer stitches 52, making for a generally less robust attachment.

Figure 4:
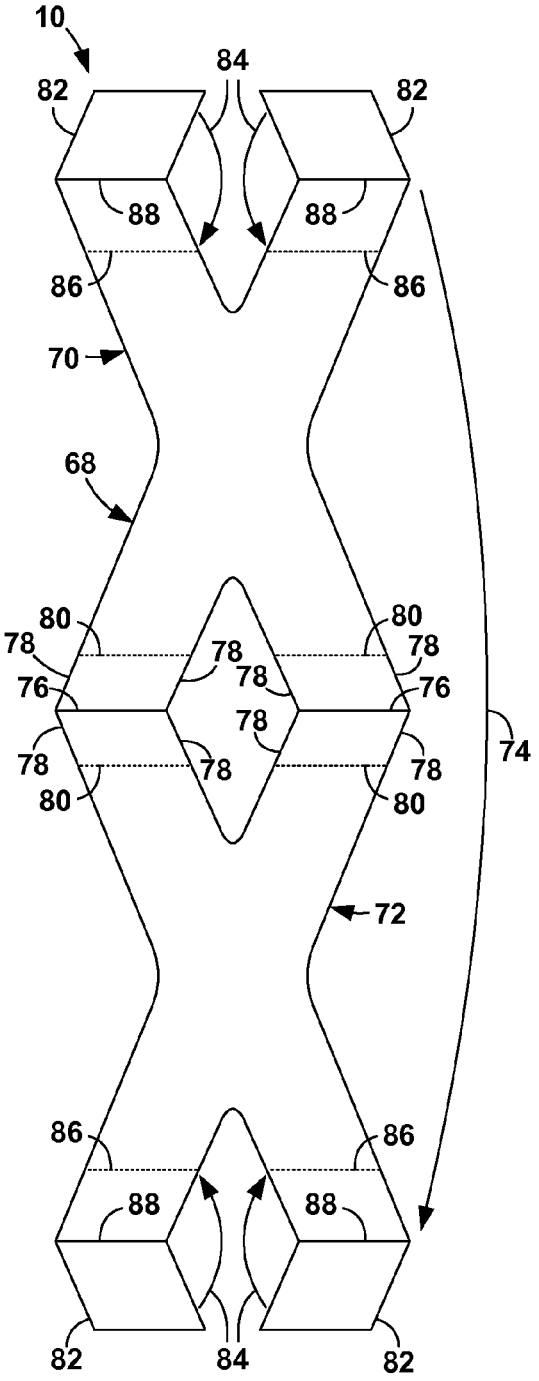
FIG. 4 is a front view of the harness of FIG. 1 before assembly in the third method.
Figure 5:
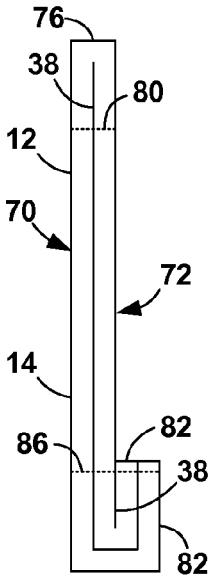
FIG. 5 is a side view of the completed harness of FIG. 4.

In the third method, shown in FIGS. 4 and 5, the harness 10 is composed of two layers of material. Two mirror image X-shaped sections 70, 72 are formed from a single-layer sheet 68 of material, where the mirror image sections 70, 72 are attached at the ends of one of the pairs of arms 14, 16. The top section 70 is folded over at a fold line 76, as at 74, to substantially overlap the bottom section 72. After folding, the edges of the harness are optionally stitched or otherwise adhered to prevent the two sections 70, 72 from separating. Optionally, the harness 10 is sewn with the outside in and then inverted. A short section 78 adjacent to the fold line 76 is left unstitched for the belt loop 38 on the first arms 14. An optional transverse stitch 80 makes sure the gait belt stays at the ends of the arms 14.

The second belt loops 38 are formed by a loop extension 82 at the arm ends. The loop extension 82 is at an angle to the rest of the arm 16 so that when the loop extension 82 is folded over an extension fold line 88, as at 84, the loop extension 82 lays over the arm 16, as in FIG. 5. A transverse stitch 86 forms the loop 38. The extension fold line 88 becomes the free end 44, 46.

Figure 6:
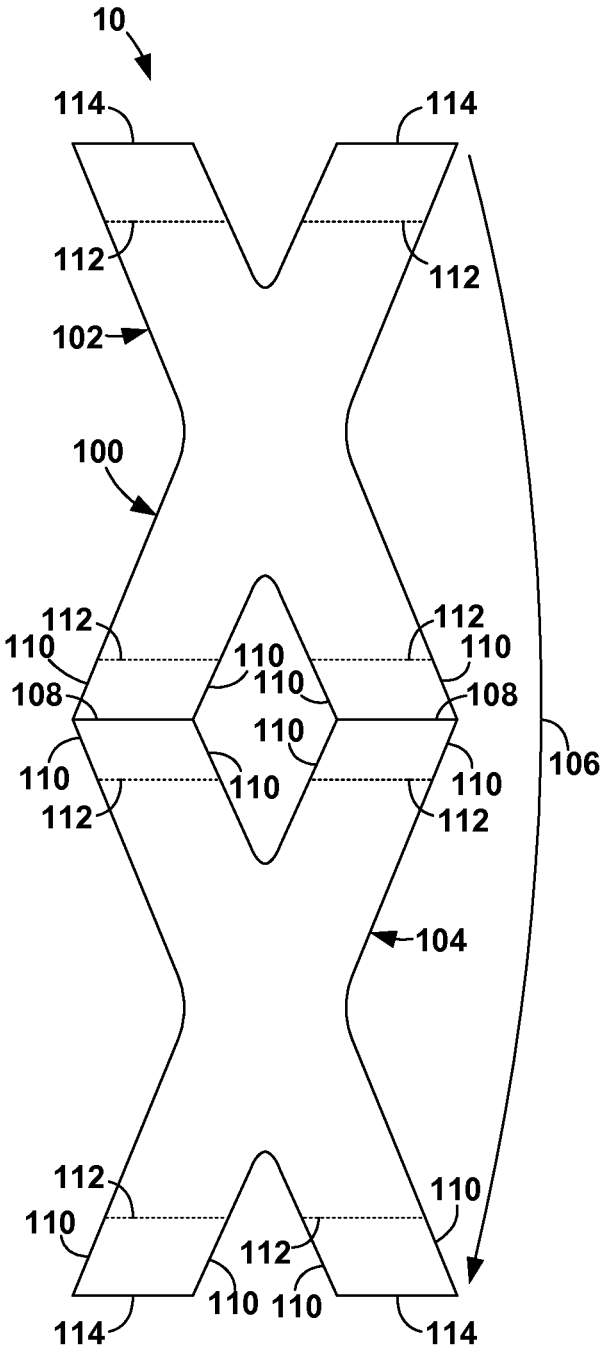
FIG. 6 is a front view of the harness of FIG. 1 before assembly in the fourth method.
Figure 7:
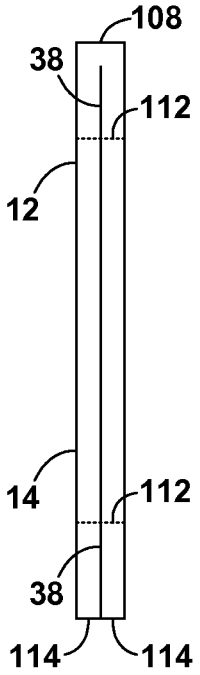
FIG. 7 is a side view of the completed harness of FIG. 6.

In the fourth method, shown in FIGS. 6 and 7, the harness 10 composed of two layers of material. Two mirror image X-shaped sections 102, 104 are formed from a single sheet 100 of material, where the mirror image sections 102, 104 are attached at the ends of one pair of arms 14, 16. The top section 102 is folded over at a fold line 108, as at 106, to substantially overlap the bottom section 104. After folding, the edges of the harness are stitched or otherwise adhered to prevent the two sections 102, 104 from separating. Optionally, the harness 10 is sewn with the outside in and then inverted. A short section 110 adjacent to the fold line 108 and ends is left unstitched for the belt loop 38. A transverse stitch 114 at the end of the arms and a transverse stitch 112 a short distance from the end of the arms forms the belt loops 38. As with the second method of FIG. 3, the major shortcoming of this structure is that, when lifting the patient, the gait belt is putting pressure directly on the outer stitches 114, making for a less robust attachment.

The belt loop 38 is wide enough to accommodate gait belts with belt buckles. The typical gait belt is 2 inches wide with a buckle that is 2½ inches wide. The belt loop 38 is in the range of from approximately 2 inches to approximately 4 inches.

The size of the harness 10 will depend on the size of the patient with which it will be used. Typically, the harness 10 is made in standard sizes that fit a range of patients.

In one configuration, the harness 10 is made in two sizes. The small harness is intended for patients up to approximately 200 pounds and up to a 42-inch waist. The width 60 at the crotch is approximately 6½ inches, which increases to approximately 17 inches at the ends, as at 62. Each arm 14, 16 has a width 64 of approximately 5 inches. The gaps 26, 28 are approximately 6 inches. The total length 58 is approximately 27 inches.

The large harness is intended for patients from approximately 175 to approximately 350 pounds and up to a 60-inch waist. The width 60 at the crotch is approximately 8 inches, which increases to approximately 21 inches at the ends, as at 62. Each arm 14, 16 has a width 64 of approximately 6 inches. The gaps 26, 28 are approximately 6 inches. The total length 58 is approximately 35 inches.

Figure 8:
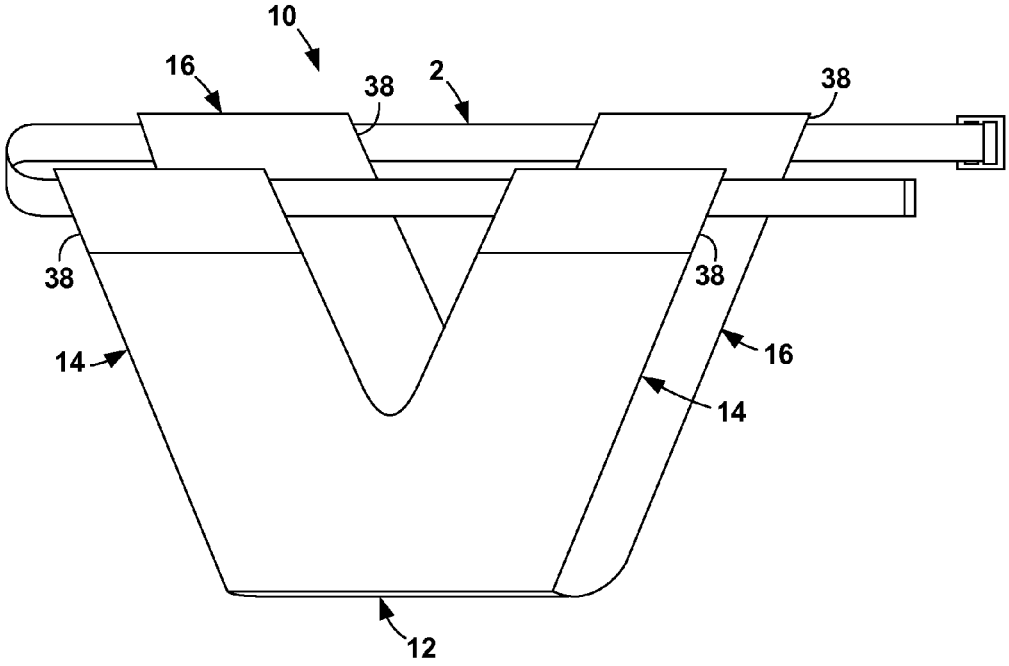
FIG. 8 is a front view of the harness of FIG. 1 with a gait belt installed.
Figure 9:
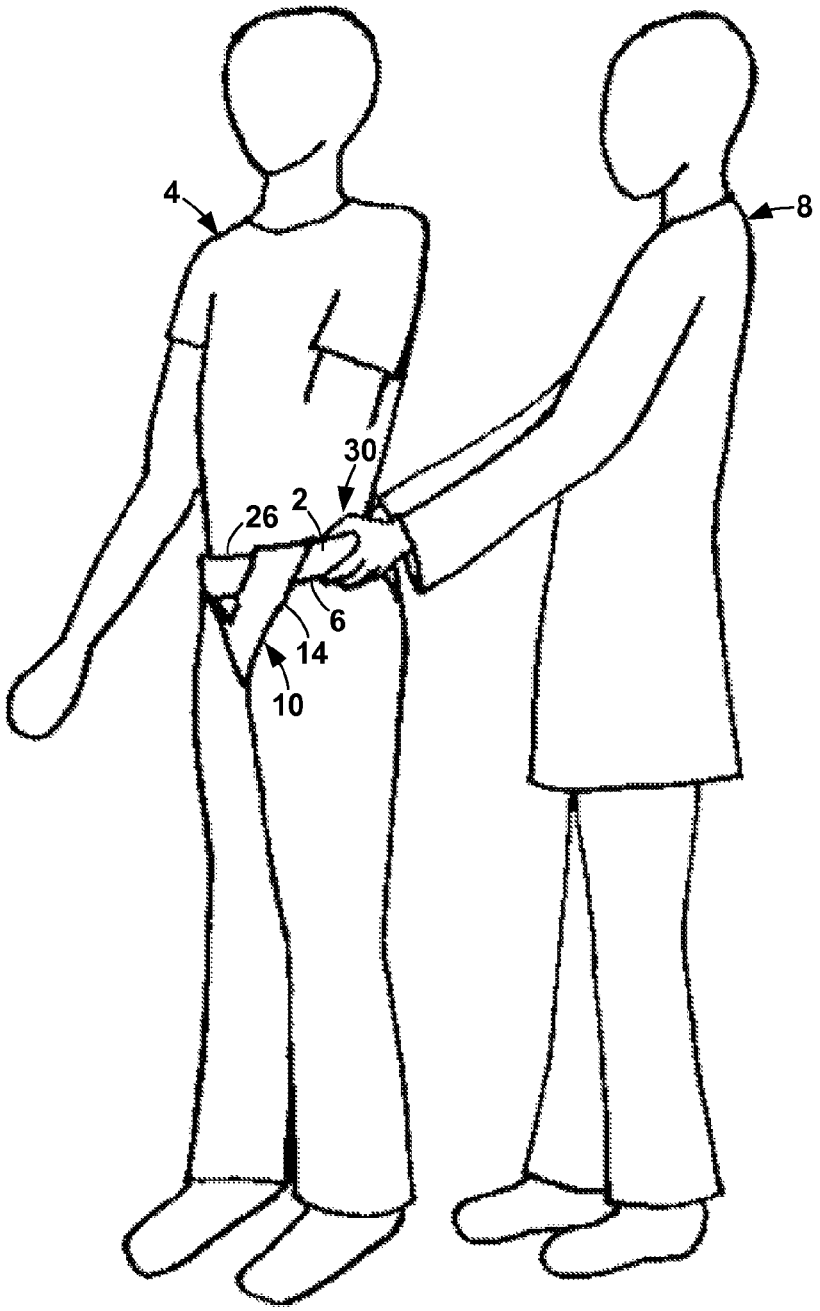
FIG. 9 is a perspective view of the harness of FIG. 1 being worn by a patient.

To put the harness 10 on the patient, the crotch portion 12 is place between the patient's legs at the crotch. The first arms 14 and second arms 16 are lifted upwardly toward the patient's waist. The gait belt 2 is threaded through the four loops 38, as shown in FIG. 8, and cinched around the patient's waist, as shown in FIG. 9.

The gap 26 between the first arms 14 and the gap 28 between the second arms 16 expose the gait belt 2 at the front and rear of the patient 4. The gait belt 2 is also exposed at the sides of the patient 4. As shown in FIG. 9, these exposed sections 6 of the gait belt 2 provide hand holds on the gait belt 2, as at 30, for the therapist 8 during lifting, sliding, standing, and/or walking with a patient 4. Since the harness 10 and gait belt 2 stay securely in place, the therapist 8 is able to offer effective manual techniques and facilitation for improved weight shift and step length during gait training.

The patient lift assist harness 10 of the present invention has a number of advantages over the current belts and harnesses.

1. It has no attached straps or fasteners.

2. It prevents the gait belt from riding up, thereby maintaining where it is designed be. As a consequence, it is safer for patients with G-tubes as it keeps the gait belt from rising and putting pressure on the tube site.

3. It provides secure, comfortable support through patient's pelvis during lifting and sliding. The wide crotch area of the harness minimizes digging into the patient's skin during use.

4. It provides improved leverage for the clinician during lifting which allows for better body mechanics and decreased risk of strain. It decreases the risk of patient falls and injuries during transfers. The increased support provides patients with a sense of security which will improve functional outcomes.

5. It is easy to put on the user with the gait belt by rolling in a supine position or by weight shifting in a sitting position. It is applied to a debilitated patient in the same manner as an adult brief.

Thus it has been shown and described a patient lift assist harness. Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A patient lift assist harness for use on a patient with a gait belt, the harness comprising:

(a) a sheet of generally X-shaped flexible fabric material with a central crotch portion, a pair of first arms extending from the crotch portion to first arm free ends and having a first angle therebetween in the range of from 30° to 65°, and a pair of second arms extending from the crotch portion to second arm free ends and having a second angle therebetween in the range of from 30° to 65°;

(b) each of the first arm free ends and the second arm free ends having a belt loop adapted to accept the gait belt.

2. The patient lift assist harness of claim 1 wherein the first angle and the second angle are approximately 45°.

3. The patient lift assist harness of claim 1 wherein the sheet has a single layer.

4. The patient lift assist harness of claim 1 wherein the sheet has multiple layers.

5. The patient lift assist harness of claim 1 wherein the first arm free ends are generally collinear with each other and the second arm free ends are generally collinear with each other.

6. The patient lift assist harness of claim 1 wherein the belt loops are formed by folding loop extensions over at an extension fold line and sewing to the arm, wherein the extension fold line becomes the free end.

7. The patient lift assist harness of claim 1 wherein the sheet is composed of a single layer of material in two generally X shape sections connected at the pair of first arms, and folded over to substantially overlap.

8. The patient lift assist harness of claim 7 wherein the first arm belt loops are formed by the fold between the two sections and the second arm belt loops are formed by folding loop extensions over at an extension fold line and sewing to the arm, wherein the extension fold line becomes the free end.

9. A patient lift assist harness for use on a patient with a gait belt, the harness comprising:

(a) a multiple-layer sheet of generally X-shaped flexible fabric material with a central crotch portion, a pair of first arms extending from the crotch portion to first arm free ends and having a first angle therebetween in the range of from 30° to 65°, and a pair of second arms extending from the crotch portion to second arm free ends and having a second angle therebetween in the range of from 30° to 65°, the first arm free ends being generally collinear with each other and the second arm free ends being generally collinear with each other;

(b) each of the first arm free ends and the second arm free ends having a belt loop adapted to accept the gait belt.

10. The patient lift assist harness of claim 9 wherein the first angle and the second angle are approximately 45°.

11. The patient lift assist harness of claim 9 wherein the belt loops are formed by folding loop extensions over at an extension fold line and sewing to the arm, wherein the extension fold line becomes the free end.

12. The patient lift assist harness of claim 9 wherein the sheet is composed of a single layer of material in two generally X shape sections connected at the pair of first arms, and folded over to substantially overlap.

13. The patient lift assist harness of claim 12 wherein the first arm belt loops are formed by the fold between the two sections and the second arm belt loops are formed by folding loop extensions over at an extension fold line and sewing to the arm, wherein the extension fold line becomes the free end.

* * * * *